US005262737A

United States Patent [19]

Siverling

[11] Patent Number: 5,262,737

[45] Date of Patent: Nov. 16, 1993

[54] DATA PROCESSING SYSTEM AND HOUSING HAVING REDUCED ELECTROMAGNETIC EMISSIONS

[75] Inventor: Michael M. Siverling, Rochester, Minn.

[73] Assignee: International Business Machines Corporation, Armonk, N.Y.

[21] Appl. No.: 923,109

[22] Filed: Jul. 30, 1992

[51] Int. Cl.[5] ..... H01P 1/20

[52] U.S. Cl. ..... 333/12; 174/35 R; 333/81 B; 333/248; 361/683; 361/818

[58] Field of Search ..... 333/12, 208, 210, 81 B, 333/248, 99 R; 174/32, 35 R; 361/424

[56] References Cited

U.S. PATENT DOCUMENTS

| | | | |
|---|---|---|---|
| 3,219,747 | 11/1965 | McAdams | 174/35 |
| 3,964,072 | 6/1976 | White | 333/81 B X |
| 4,754,101 | 6/1988 | Stickney et al. | 174/35 |
| 4,836,955 | 6/1989 | Ehrreich | 252/512 |
| 4,926,291 | 5/1990 | Sarraf | 361/384 |
| 4,980,516 | 12/1990 | Nakagawa | 174/35 |
| 5,047,898 | 9/1991 | Cooke et al. | 361/424 |
| 5,063,273 | 11/1991 | Bloks | 174/35 |
| 5,165,055 | 11/1992 | Metsler | 333/12 |
| 5,204,497 | 4/1993 | Herrick | 174/35 R |

OTHER PUBLICATIONS

IBM Technical Disclosure Bulletin, vol. 31, No. 3, Aug. 1988, pp. 37-38, Entitled "Universal Three-and-One-Half-Inch Direct Access Storage Device Slide".

IBM Technical Disclosure Bulletin, vol. 33, No. 6A, Nov. 1990, pp. 213-218, Entitled "Self-Contained, Self-Secured Grounding Spring Providing EMC Shielding Between Plastic and/or Metal Covers and Enclosures".

Research Disclosure, Feb. 1992, No. 33416, Entitled "Total EMI Disclosure".

1989 International Symposium on Electromagnetic Compatibility, IEEE, vol. 2, pp. 846-850, Entitled "Suppressing Magnetic Field Radiation Through Apertures in Metal Cabinet" by K. Hatakeyama and H. Nishizuka.

*Primary Examiner*—Paul Gensler

*Attorney, Agent, or Firm*—Andrew J. Dillon

[57] ABSTRACT

A data processing system and housing are disclosed having reduced electromagnetic energy emissions. A central processor is mounted within a generally rectangular conductive outer case which includes one or more apertures for receiving and mounting electronic subassemblies such as: diskette drives; fixed disk drives; tape drives; and, optical disk readers. A conductive waveguide assembly having at least one waveguide is then mounted within the conductive outer case with one end of the waveguide mated conductively to the aperture within the conductive outer case. Electromagnetic energy from the electronic subassembly or from within the conductive outer case must then traverse the conductive waveguide prior to emission from the data processing system housing through the aperture therein. The shielding effect of requiring electromagnetic emissions to traverse an internal waveguide will provide substantial attenuation of electromagnetic interference.

8 Claims, 2 Drawing Sheets

DATA PROCESSING SYSTEM AND HOUSING HAVING REDUCED ELECTROMAGNETIC EMISSIONS

BACKGROUND OF THE INVENTION

1. Technical Field:

The present invention relates in general to an improved data processing system and in particular to an improved data processing system having reduced emissions of electromagnetic energy. Still more particularly, the present invention relates to an improved data processing system outer case having reduced emissions of electromagnetic energy from apertures within the case having electronic subassemblies mounted therein.

2. Description of the Related Art:

Modern data processing systems often incorporate multiple electronic subassemblies which may be mounted in and removed from so-called "bays" or apertures within a data processing system housing. A problem which exists with such data processing systems is the amount of electromagnetic emissions which are generated by the data processing system and electronic subassemblies such as diskette drives, fixed disk drives, tape drives and optical disk readers.

The amount of electromagnetic interference or "noise" which may be emitted by a data processing system is strictly limited by government regulation. As the performance attributes of modern state-of-the-art electronic subassemblies are increased, such assemblies emit greater amounts of radio frequency noise. This is due in part to the electronic elements, such as very fast field effect transistor (FET) logic families which are utilized in such devices. While a data processing system is typically mounted within a case or housing, which is conductive and thus impermeable to radio frequency noise, such housings typically include removable panels which cover bays or apertures which may be utilized to insert electronic subassemblies such as those described above.

When such a panel is removed to insert a fixed disk drive and then replaced, the panel will block electromagnetic emissions from the device. However, certain electronic subassemblies require user access to the interior aspects of such a subassembly. For example, optical disk readers and diskette drives require an aperture which permits the operator to insert a diskette or optical disk. Such devices are typically installed within a bay or aperture within the data processing system housing and then surrounded by a plastic bezel or frame which permits the operator to insert a diskette or optical disk.

In such applications, electromagnetic energy from within the data processing system may "leak" around the diskette drive or optical disk reader through these plastic bezels and cause unacceptable levels of electromagnetic emissions in the vicinity of the data processing system.

It should therefore be apparent that a need exists for a system which permits electronic subassemblies to be mounted within apertures within a data processing system housing but which minimize or attenuates the amount of electromagnetic interference emitted from those apertures during operation of the data processing system.

SUMMARY OF THE INVENTION

It is therefore one object of the present invention to provide an improved data processing system.

It is another object of the present invention to provide an improved data processing system having reduced emissions of electromagnetic energy.

It is yet another object of the present invention to provide an improved data processing system outer case having reduced emissions of electromagnetic energy from apertures within the case by electronic subassemblies mounted therein.

The foregoing objects are achieved as is now described. A data processing system and housing are provided which exhibit reduced emission of electromagnetic energy. A central processor is mounted within a generally rectangular conductive outer case which includes one or more apertures for receiving and mounting electronic subassemblies such as: diskette drives; fixed disk drives; tape drives; and, optical disk readers. A conductive waveguide assembly having at least one waveguide is then mounted within the conductive outer case with one end of the waveguide mated conductively to the aperture within the conductive outer case. Electromagnetic energy from the electronic subassembly or from within the conductive outer case must then traverse the conductive waveguide prior to emission from the data processing system housing through the aperture therein. The shielding effect of requiring electromagnetic emissions to traverse an internal waveguide will provide substantial attenuation of electromagnetic interference.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
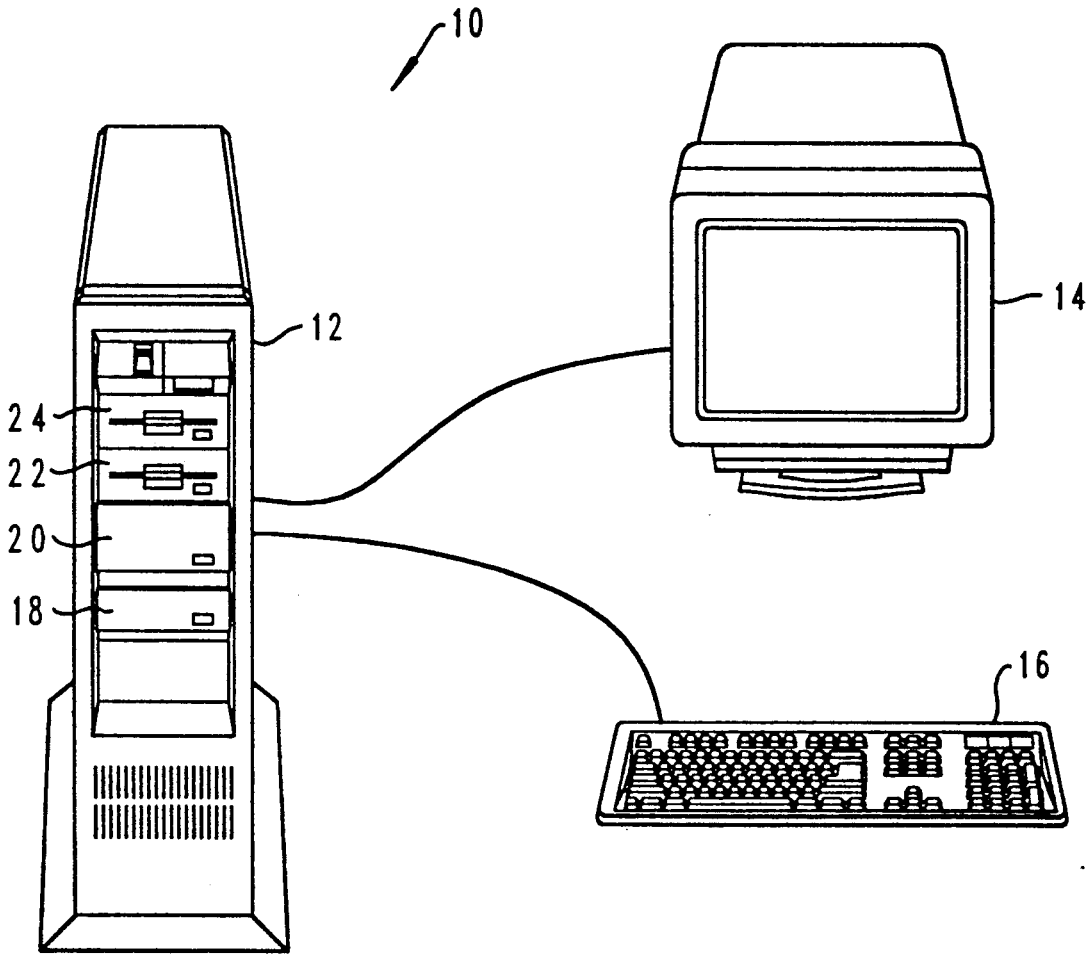
FIG. 1 is a pictorial representation of a data processing system constructed in accordance with the present invention.

With reference now to the figures and in particular with reference to FIG. 1, there is depicted a pictorial representation of a data processing system 10 which is constructed in accordance with the present invention. As illustrated, data processing system 10 preferably includes a generally rectangular conductive housing 12 which, in the depicted embodiment of the present invention, may be constructed of metallic material, such as steel, or may be constructed of plastic having a conductive lining. Of course, those skilled in the art will appreciate that by constructing generally rectangular conductive housing 12 of a metallic material or conductive lined plastic, the vast majority of electromagnetic emissions generated by electronic subassemblies and materials within the housing will be attenuated. As is typical in such data processing systems a display 14 and keyboard 16 are also provided.

Data processing system 10 may include one or more electronic subassemblies mounted within generally rectangular conductive housing 12 such as: fixed disk drive 18; fixed disk drive 20; and, diskette drives 22 and 24. Of course, as will be apparent to those having skill in this art, two half height diskette drives 22 and 24 may be replaced by a single full height diskette drive.

Figure 2:
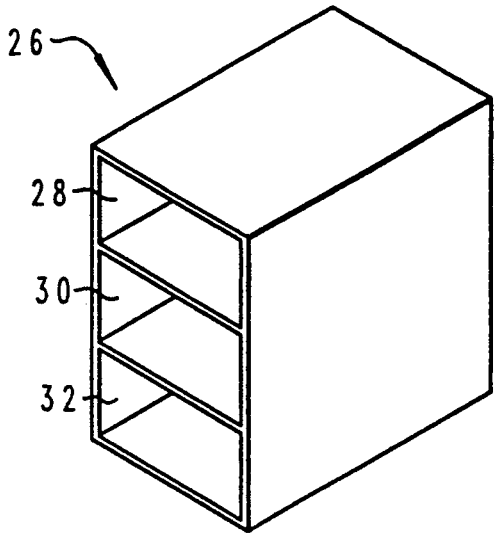
FIG. 2 is a perspective view of a conductive waveguide assembly which may be utilized within the data processing system of FIG. 1 in accordance with the present invention.

Referring now to FIG. 2, there is depicted a perspective view of a conductive waveguide assembly which has been constructed for utilization within data processing system 10 of FIG. 1 in accordance with the present invention. As illustrated, this embodiment of conductive waveguide assembly 26 preferably includes a plurality of waveguide apertures 28, 30, and 32. As with generally rectangular conductive housing 12, conductive waveguide assembly 26 may be constructed utilizing a metallic material, such as steel, or may be constructed utilizing a plastic material which has been lined with a conductive material to form the plurality of conductive waveguides thus illustrated.

Figure 3:
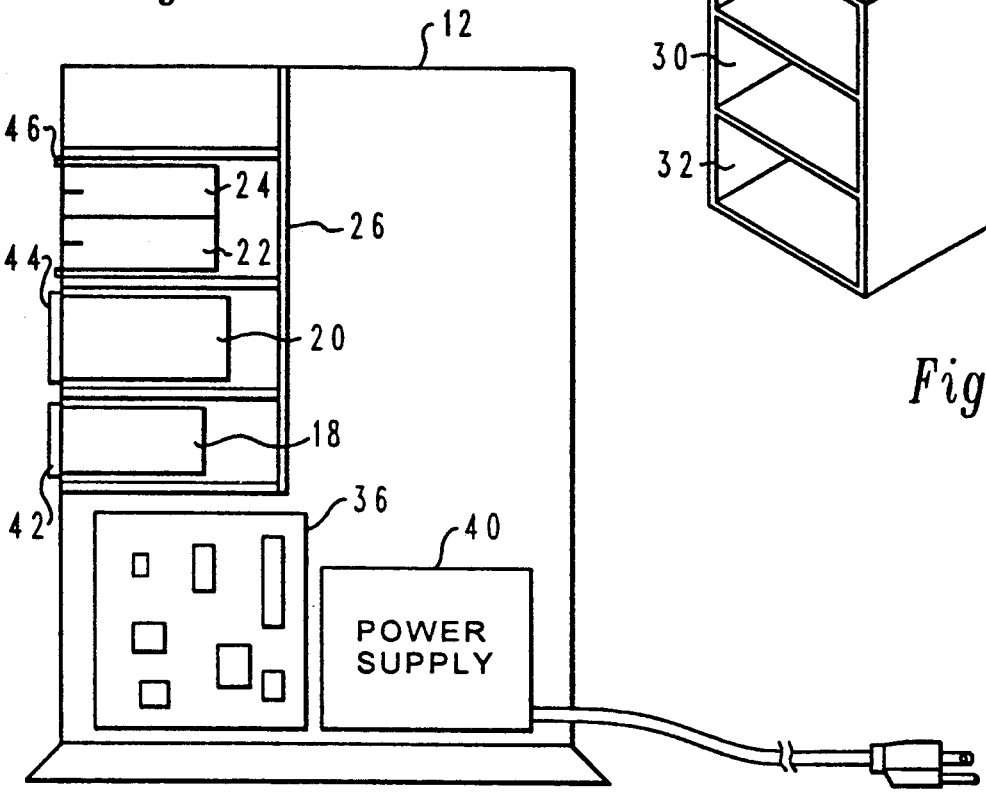
FIG. 3 is a cut-away view of the data processing system of FIG. 1 illustrating the conductive waveguide assembly of FIG. 2 mounted therein.

With reference now to FIG. 3, there is depicted a cut-away view of data processing system 10 of FIG. 1, illustrating conductive waveguide assembly 26 mounted therein in accordance with the present invention. As illustrated, generally rectangular conductive housing 12 includes those components and subassemblies typically present within a data processing system, such as motherboard 36 and power supply 40. As illustrated, conductive waveguide assembly 26 is mounted within generally rectangular conductive housing 12 such that waveguide apertures 28, 30, and 32 align with and may be conductively mated with the bays or apertures formed within the upper frontal surface of generally rectangular housing 12. Thus, disk drive 18 is mounted within waveguide aperture 32 behind cover plate 42. Similarly, disk drive 20 is mounted within waveguide aperture 30 behind cover plate 44 and, diskette drives 22 and 24 are mounted within waveguide aperture 28 and surrounded by cover bezel 46.

As described above, in the absence of conductive waveguide assembly 26 disclosed within the present application, electromagnetic energy from within generally rectangular conductive housing 12 will typically be emitted from the aperture surrounding diskette drives 22 and 24 through cover bezel 46. Thus, electromagnetic energy generated by the operation of fixed disk drive 18, fixed disk drive 20, mother board 36 and power supply 40 will result in increased emissions of electromagnetic energy from the aperture surrounding diskette drives 22 and 24, due to the plastic nonconductive nature of cover bezel 46 and the fact that diskette drives 22 and 24 typically require an aperture therein which will permit the operator to insert a diskette.

However, in accordance with the present invention, the provision of conductive waveguide assembly 26, when conductively mated with each aperture or bay within generally rectangular conductive housing 12, will result in a conductive waveguide path through which electromagnetic energy must pass prior to being emitted from waveguide aperture 28 through cover bezel 46. Indeed, electromagnetic energy which originates from fixed disk drive 18 must also traverse waveguide aperture 32 prior to entering waveguide aperture 28 for possible emission through cover bezel 46.

As those skilled in the art will appreciate, the provision of a conductive waveguide may enhance or attenuate the transmission of electromagnetic energy as a result of the physical dimensions of the waveguide and the frequency of the energy involved. By maximizing the so-called "Voltage Standing Wave Ratio" (VSWR) the electromagnetic energy within generally rectangular conductive housing 12 which is emitted from the apertures therein may be substantially decreased.

Figure 4:
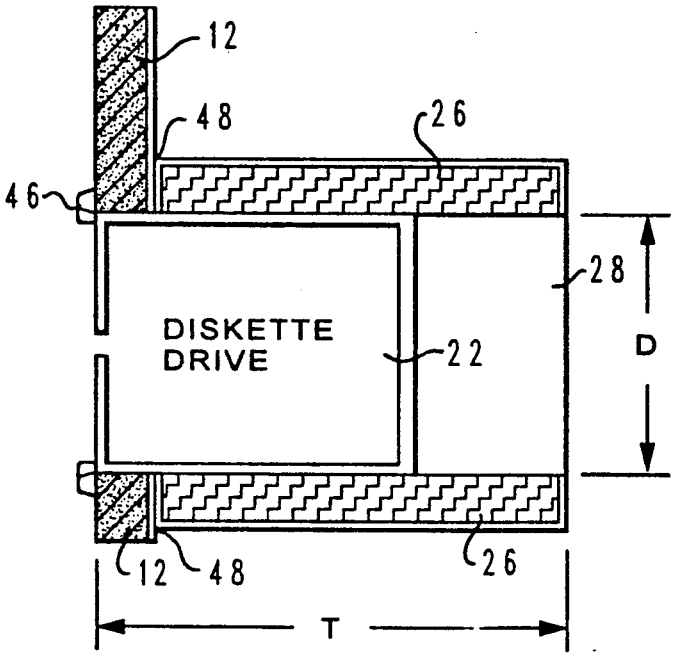
FIG. 4 is a cut-away view of an electronic subassembly mounted within the data processing system of FIG. 1 in accordance with the present invention.

Referring now to FIG. 4, there is depicted a cut-away view of an electronic subassembly mounted within data processing system 10 in accordance with the present invention. While two half height diskette drives are depicted within waveguide aperture 28 within FIG. 3, a single full height diskette drive is illustrated within FIG. 4 for simplicity of explanation. As illustrated, diskette drive 22 includes a slot into which a diskette may be inserted. Thus, electromagnetic energy from within data processing system 10 may be emitted through the slot within diskette drive 22 or through the aperture within which diskette drive 22 is mounted through cover bezel 46, in the manner described above.

However, by providing a conductive waveguide utilizing a portion of conductive waveguide assembly 26, which is conductively mated to generally rectangular conductive housing 12, at points 48, a seamless conductive waveguide aperture is provided. Thus, the only apertures through which electromagnetic energy may escape require that the electromagnetic energy traverse the length of waveguide aperture 28, as illustrated. However, waveguide aperture 28 provides an attenuation for the frequencies of electromagnetic interference typically encountered in the data processing system by an amount which may be set forth by formula (1) listed below:

$$S=32T/D \text{ (dbmv)}.$$

Thus, if the shelf depth T of waveguide aperture 28 is equal to or greater than the major dimension D of waveguide aperture 28, 32 dbmv of attenuation should be expected. Thus, by forcing electromagnetic energy within data processing system 10 to traverse at least one conductive waveguide prior to emission from generally rectangular conductive housing 12, the amount of electromagnetic energy emitted from data processing system 10 may be greatly reduced.

While the invention has been particularly shown and described with reference to a preferred embodiment, it will be understood by those skilled in the art that various changes in form and detail may be made therein without departing from the spirit and scope of the invention.

I claim:

1. A data processing system housing for minimizing electromagnetic emissions from electronic subassemblies mounted therein, said data processing system housing comprising:

a generally rectangular conductive outer case having at least one aperture therein adapted to receive an electronic subassembly; and an elongate conductive waveguide having a length which is greater than or equal to a maximum dimension of said at least one aperture such that a Voltage Standing Wave Ratio within said elongate conductive waveguide is maximized for said electromagnetic emissions, said elongate conductive waveguide mounted inside said generally rectangular conductive outer case within said at least one aperture and conductively mated at one end thereof to said aperture wherein electromagnetic energy from an electronic subassembly within said data processing system housing must traverse said conductive waveguide prior to emission from said data processing system housing.

2. The data processing system housing for minimizing electromagnetic emissions from electronic subassemblies mounted therein according to claim 1, wherein said generally rectangular conductive outer case comprises a generally rectangular metallic outer case.

3. The data processing system housing for minimizing electromagnetic emissions from electronic subassemblies mounted therein according to claim 1, wherein said elongate conductive waveguide comprises a conductive waveguide assembly including a plurality of parallel elongate waveguides therein.

4. The data processing system housing for minimizing electromagnetic emissions from electronic subassemblies mounted therein according to claim 3, wherein said elongate conductive waveguide assembly comprises a plastic waveguide assembly having a conductive lining therein.

5. A data processing system having reduced electromagnetic emissions, said data processing system comprising:

a generally rectangular conductive outer case having at least one aperture therein adapted to receive an electronic subassembly;

a central processing unit mounted within said generally rectangular conductive outer case;

an elongate conductive waveguide having a length which is greater than or equal to a maximum dimension of said at least one aperture such that a Voltage Standing Wave Ratio within said elongate conductive waveguide is maximized for said electromagnetic emissions, said elongate conductive waveguide mounted inside said generally rectangular conductive outer case within said at least one aperture and conductively mated at one end thereof to said aperture; and at least one electronic subassembly mounted within said conductive waveguide wherein electromagnetic energy from an electronic subassembly within said data processing system must traverse said conductive waveguide prior to emission from said data processing system.

6. The data processing system having reduced electronic emissions according to claim 5, wherein said generally rectangular conductive outer case comprises a generally rectangular metallic outer case.

7. The data processing system having reduced electronic emissions according to claim 5, wherein said conductive elongate waveguide comprises a conductive waveguide assembly including a plurality of parallel elongate waveguides therein.

8. The data processing system having reduced electronic emissions according to claim 7, wherein said elongate conductive waveguide assembly comprises a plastic waveguide assembly having a conductive lining therein.

* * * * *